US008272441B2

(12) United States Patent
Umphries et al.

(10) Patent No.: US 8,272,441 B2
(45) Date of Patent: Sep. 25, 2012

(54) WIRELESS DOWNHOLE TOOL POSITIONING SYSTEM

(76) Inventors: Don Umphries, New Iberia, LA (US); Gabe Williger, Dallas, TX (US)

( * ) Notice: Subject to any disclaimer, the term of this patent is extended or adjusted under 35 U.S.C. 154(b) by 0 days.

(21) Appl. No.: 13/135,996

(22) Filed: Jul. 19, 2011

(65) Prior Publication Data

US 2011/0308797 A1 Dec. 22, 2011

Related U.S. Application Data

(63) Continuation-in-part of application No. 12/579,900, filed on Oct. 15, 2009.

(51) Int. Cl.
*E21B 29/00* (2006.01)

(52) U.S. Cl. ..... 166/297; 166/242.6; 166/299; 166/55

(58) Field of Classification Search ..... 166/297, 166/376, 299, 55, 242.6, 192
See application file for complete search history.

(56) References Cited

U.S. PATENT DOCUMENTS

| | | | | |
|---|---|---|---|---|
| 2,249,511 | A * | 7/1941 | Westall | 166/291 |
| 2,894,587 | A * | 7/1959 | McCulloch | 166/123 |
| 4,298,063 | A * | 11/1981 | Regalbuto et al. | 166/55 |
| 4,685,516 | A * | 8/1987 | Smith et al. | 166/65.1 |
| 7,168,493 | B2 * | 1/2007 | Eddison | 166/334.4 |

* cited by examiner

*Primary Examiner* — Kenneth L Thompson
*Assistant Examiner* — Ronald Runyan
(74) *Attorney, Agent, or Firm* — W. Allen Marcontell

(57) ABSTRACT

A system for positioning a downhole tool along a pipe string, the system having a series of seating subs inserted along the length of the pipe string wherein each seating sub has a seating aperture disposed around its internal periphery so as to form a bore plug seat of smaller diameter than the diameter of the pipe. The seating apertures are given distinctive diameters that are consecutively arranged along the pipe string length so that the aperture diameters decrease with increasing depth. A drop assembly having an aperture plugging diameter selected to pressure seal a selected aperture includes a bore pressure activated by-pass valve and firing head.

27 Claims, 9 Drawing Sheets

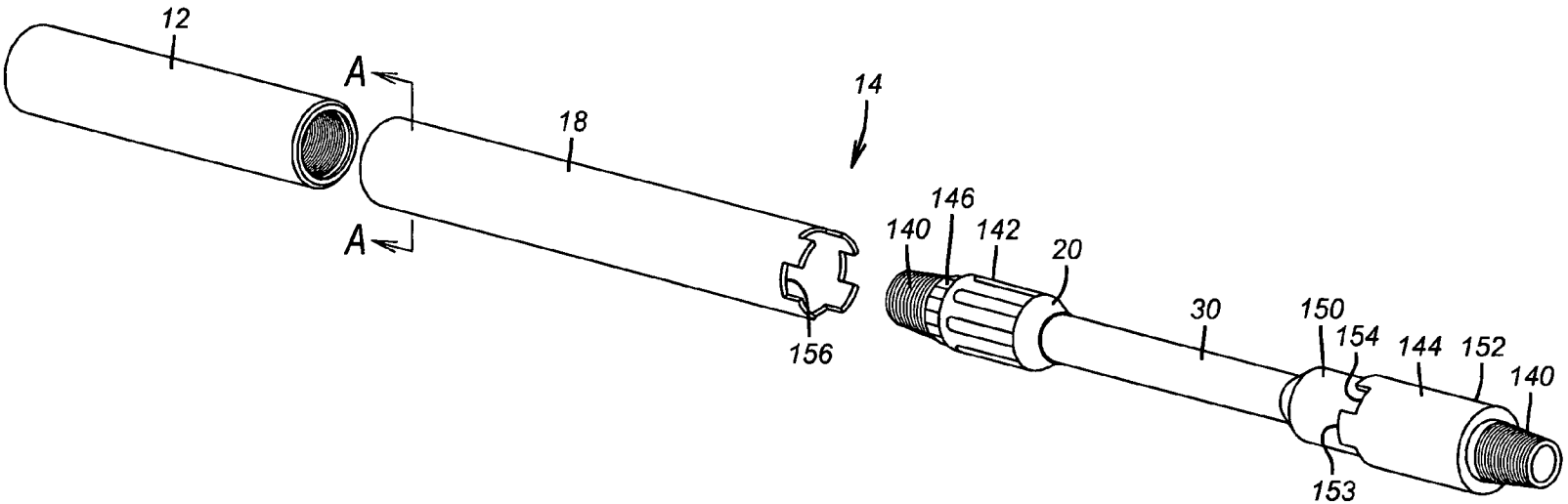
FIG. 5
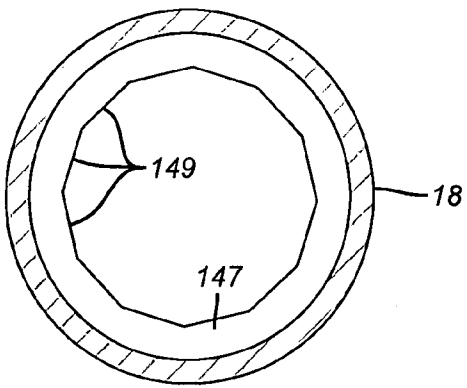
FIG. 5A-A

WIRELESS DOWNHOLE TOOL POSITIONING SYSTEM

CROSS-REFERENCE TO RELATED APPLICATION

This application is a Continuation-In-Part of U.S. application Ser. No. 12/579,900 filed on Oct. 15, 2009 and claims the priority date of said application Ser. No. 12/579,900 for subject matter common therewith. Said application Ser. No. 12/579,900 claims the priority date of Provisional Application No. 61/242,251

BACKGROUND OF THE INVENTION

Field of the Invention

The present invention relates to a system and method for landing/positioning a device at a known depth within a pipe string suspended within a wellbore without the use of a-line, wireline, slickline or similar tether lowered from the surface. The present invention is preferably utilized to position a downhole tool such as, for example, a jet cutter, a shaped charge, a perforating gun, an explosive charge, a perforating gun or well logging sensor in a tubing string for purposes of pipe cutting, pipe perforation, formation perforation, pipe recovery, well plugging, well logging or similar exercises. In one embodiment, the invention relates to placement of explosive charges or a jet cutter within a short section of easily and confidently severed pipe that may be inserted at numerous locations in a pipe string at numerous predetermined locations for separating an upper portion of a pipe string from a lower portion at a precisely predetermined location. In another embodiment, the invention relates to a well logging method that requires no surface linkage during the survey.

SUMMARY OF THE INVENTION

The present invention system provides a series of internally profiled seating subs which are distributed within a pipe string to form a plurality of spaced apart pipe bore apertures immovably disposed along the pipe string length. Each seating sub aperture is characterized by a cross-sectional profile of varying shape with an aperture of a predetermined diameter formed therein. The internally profiled seating subs are arranged so that the aperture diameters decrease in regressive increments as the pipe string extends deeper in a well bore. Utilized in conjunction with these internally profiled seating subs is a sealing plug of an external diameter selected to sealingly engage a specific one of said profiled seating subs. The select diameter sealing plug is configured to be secured to the exterior of a down hole tool assembly that includes a service tool such as a firing head, shaped charge cutter, perforating gun or stand alone well logging instrument to permit the tool assembly to be landed on a seating aperture at a desired depth. The known distance from the seating aperture to precisely where the service tool functions in the pipe string is critical to the ability to predict what service tool is best suited to achieving the desired result.

More specifically, an invention intent is to install these seating subs at strategically determined points along the length of a pipe string such as a drill string, drill pipe, drill collars, tubing, tubulars or casing in a sequence that progresses from the largest diameter aperture restriction to the smallest diameter aperture restriction. An independent device carrying a plug profile of predetermined diametric dimension, when dropped freely or pumped from the surface through the pipe string, will pass through the pipe string until the device strikes a seating aperture beyond which it cannot pass; e.g. a seating aperture diameter that is smaller than the outer diameter of the plug. A metal-to-metal (or other) seal will enable fluid pressure to be applied to the to the pipe string bore above the seal for various purposes such as, for example, triggering an explosive tool firing head and/or opening a by-pass valve and or revealing the location of a logging tool. The type of device utilized in the system can be any service tool utilized in downhole applications.

Although not intended to be limited for use with any particular device, the system is particularly useful in pipe recovery operations that may use service tools such as a jet cutter, severing tool, torch cutter or chemical cutter. Other uses for the invention may also include specific placement of perforating guns and well logging sensors.

An additional embodiment of the invention combines a restriction or internally profiled seating sub as described above with a specially designed cutaway sub. The combination of seating sub and cutaway sub may be integrated with a pipe string at numerous, spaced, but carefully measured locations along the pipe string length and especially above or along the drill string weight collars. The cutaway sub includes a sacrificial section having a reduced external diameter (reduced wall thickness), relative the upper and lower coupling portions of the sub. Utilizing an aperture profile positioned above the section of reduced pipe wall annulus that is to be severed, the appropriate severing tool (such as a jet cutter or shaped charge explosive) may be accurately and confidently located to effect a clean cut. Significantly, once the cut is made and the upper section of drill string is withdrawn, the severed end of the reduced pipe wall annulus remaining with the lower end of the drill string is easily accessed by conventional "fishing" technology because the severed end is not excessively flared. This reduced wall annulus section of pipe also facilitates perforating operations previously made very difficult if not impossible by the thickness of the drill collar. The tensile strength of a particular cutaway sub is designed to be sufficient to support the pipe string below the particular sub. This may be a variable value since those cutaway subs near the lower end of a pipe string support less pipe weight below them than those cutaway subs near the surface or top of a pipe string which must support the weight of the entire string below.

A sleeve or bushing may be installed over the reduced wall annulus section of the severing sub to ensure that the buckling and torsional strength threshold of the sub is maintained.

BRIEF DESCRIPTION OF THE DRAWINGS

The advantages and further features of the invention will be readily appreciated by those of ordinary skill in the art as the same becomes better understood by reference to the following detailed description when considered in conjunction with the accompanying drawings in which like reference characters designate like or similar elements throughout.

FIG. 5 is an exploded view of a preferred cutaway sub embodiment.

FIG. 5A-A is a cross-section view of the seating sub at cutting plane A-A of FIG. 5

DESCRIPTION OF THE PREFERRED EMBODIMENTS

As used herein, the terms "up" and "down", "upper" and "lower", "above" and "below" and other like terms indicating relative positions above or below a given point of element are used in the description to more clearly describe some embodiments of the invention. However, when applied to equipment and methods for use in wells that are deviated or horizontal, such terms may refer to a left to right, right to left or other relationship as appropriate. Moreover, in the specification and appended claims, the terms "pipe", "tube", "tubular", "casing", "liner" and/or other tubular goods are to be interpreted and defined generically to mean any and all of such elements without limitation of industry usage.

Figures 1A, 1B, 1C, 1D, 1E, 1F:
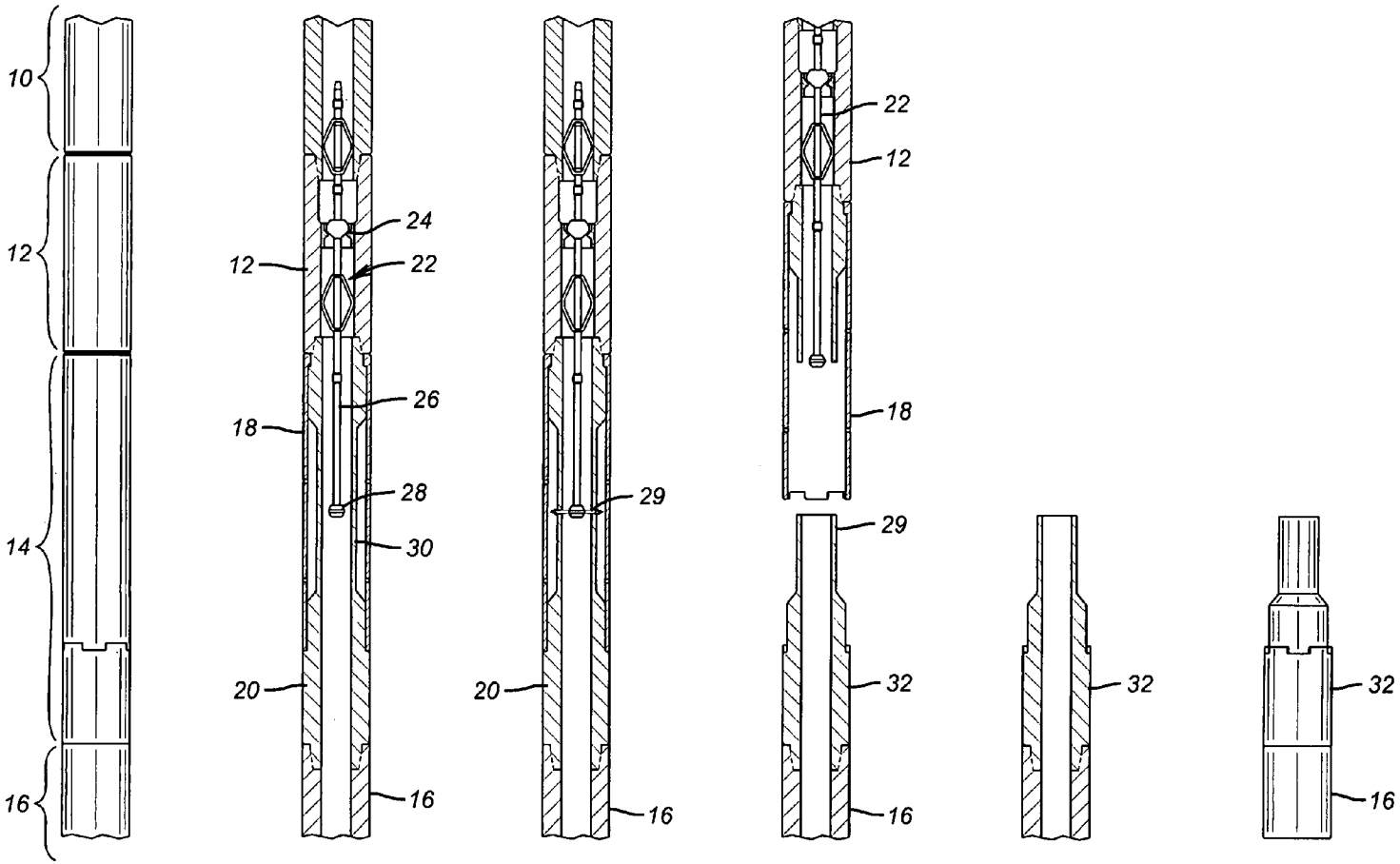
FIG. 1A illustrates a section of pipe string having two sub units of the invention inserted between a upper pipe section and a lower pipe section.
FIG. 1B is a sectioned view of FIG. 1A showing a drop assembly within the pipe string in pipe cutting position.
FIG. 1C is a sectioned view of FIG. 1A showing the discharge of a jet cutting tool against a reduced wall annulus section of the sacrificial mandrel.
FIG. 1D is a sectioned view of the severed pipe section of FIG. 1C showing withdrawal of the upper pipe section from the severed lower pipe section.
FIG. 1E is a sectioned view of the severed pipe stub remaining below the cut of FIG. 1C.
FIG. 1F is a full profile view of the severed stub remainder of the pipe section.

The basic sequence of the present invention, as practiced, for example, upon a drill string cutting operation, is represented by the six view, A-F of FIG. 1. The FIG. 1A view shows an assembly of the basic invention components in a downhole pipe string between an upper section 10 and a lower section 16. An expanded description of each of these constituent components will follow hereafter.

The FIG. 1A illustration is usually most relevant to that heavyweight section of drill pipe at the bottom end of a drill string having joints of pipe with extremely thick wall annuli. To the well driller's art, these pipe joints with exceptionally thick walls are known as "drill collars". The invention seating sub 12 and cutaway sub 14 may be positioned at the upper end of the collar section or at any intermediate point or at numerous points below the upper end. However, those of ordinary skill will understand that the principles described herein with respect to drill collars are applicable to any form or application of pipe or tube.

Referring to the sectioned view of FIG. 1B, an independent drop assembly 22 is released at the surface to be driven by pump pressure or to descend in free-fall along the pipe bore to terminate upon a plug seating aperture 24 in the seating sub 12. A drop assembly extension 26, usually extending below the seating aperture 24 is shown to support a jet cutting pyrotechnic tool such as a thermite or shaped charge explosive 28. The extension 26 length is selected to place the jet cutter 28 within the pipe bore opposite a thin wall section 30 of a sacrificial mandrel 20 portion of the cutaway sub 14.

FIG. 1B illustrates the drop assembly 22 as firmly resting upon seating aperture 24. Fluid pressure within the upper pipe string bore is increased to open a firing head valve disposed within the drop assembly 22. Opening the firing head valve initiates the jet cutter 28 ignition sequence to discharge a high temperature cutting jet along cutting plane 29 against the thin wall section 30 of the sacrificial mandrel 20 as represented by FIG. 1C.

With the thin wall section 30 of the sacrificial mandrel 20 severed, FIG. 1D shows the seating sub 12 and torque sleeve portions of the upper pipe string 10 as free to separate from the sacrificial mandrel stub 32 which remains fixed to the well bottom. FIG. 1E shows the sacrificial mandrel stub 32 portion of the cutaway sub 14 in section as remaining with the well bottom pending further, independent action of recovery or well abandonment. FIG. 1F shows the mandrel stub 32 in full profile.

Figure 2:
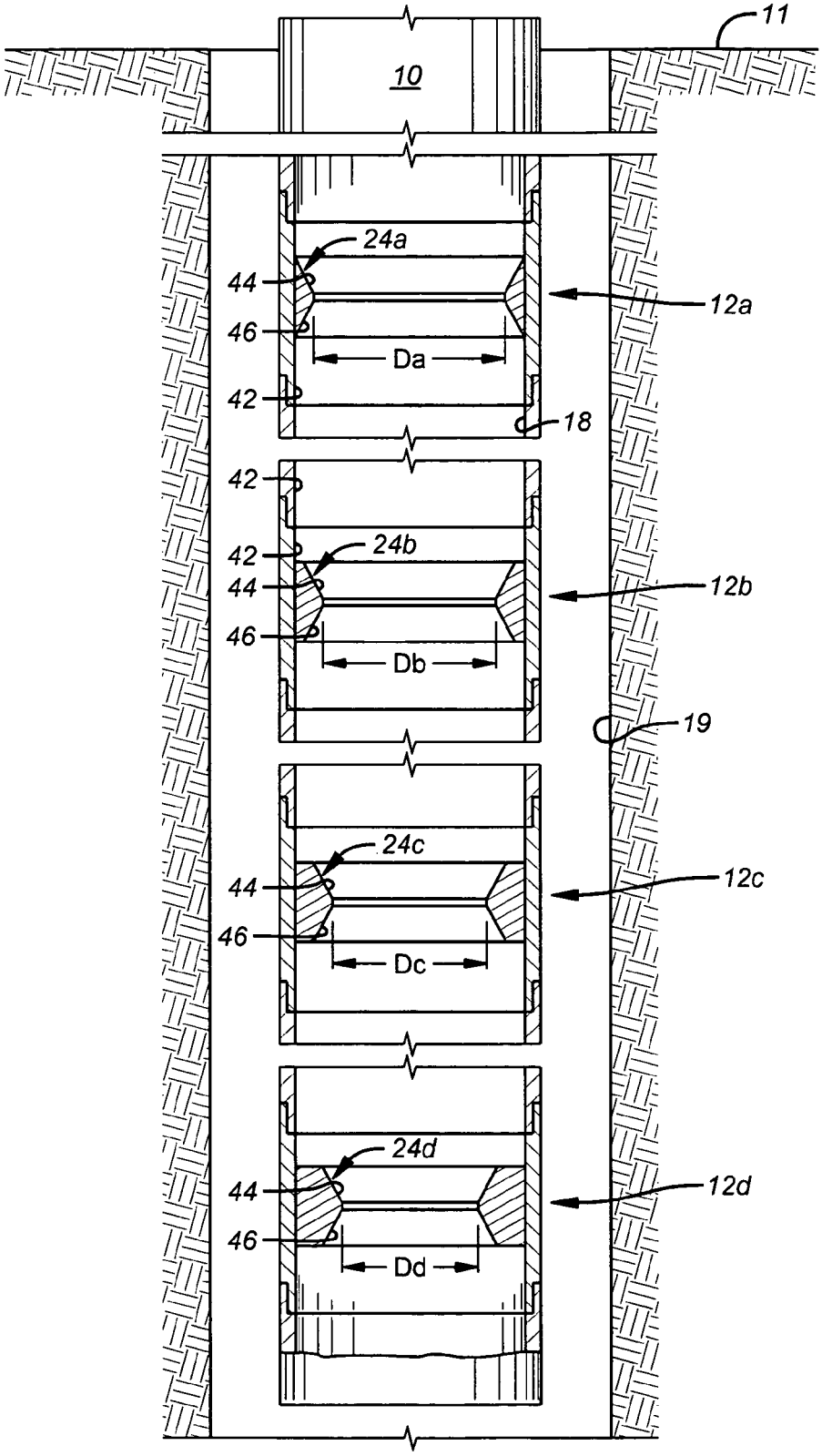
FIG. 2 portrays the cross-section of a pipe string with a series of seating apertures disposed therein to form decreasing restrictions along the length of the pipe string.

SEATING SUB While FIG. 1 illustrates the invention in one particular application and embodiment, FIG. 2 illustrates a greater and more generic application wherein a series of seating subs 12 are distributed along the length of the supported pipe string. The seating subs 12*a*, 12*b*, 12*c*, and 12*d* are internally profiled by plug seating apertures 24 of graduated diameter "D" forming restrictions in the interior diameter of the subs. The subs, positioned at measured locations in a pipe string 10 extending from the surface 11 into a well bore 19, are arranged so that the largest diameter profile or restriction is nearest to the surface, with ever decreasing (in diameter) profiles, such that the deepest/lowest sub in the string has the smallest diameter profile or restriction. For example, in FIG. 2, seating aperture 24*a* of sub 12*a*, nearest the surface 11, has the largest diameter $D_a$ restriction, while aperture 24*d* of sub 12*d*, deepest in wellbore 19, has the smallest diameter $D_d$ restriction. The consecutive diameters $D_a$, $D_b$, $D_c$, and $D_d$ decrease with depth along wellbore 19. In any event, the seating apertures 24 are disposed to engage the sealing plug 34 (shown in FIG. 3) of the drop assembly 22.

In one preferred embodiment, the seating subs 12 are only approximately two feet long and can be readily threaded or inserted into a pipe string during make-up. In one embodiment of the invention, up to five seating subs 12 are provided and arranged so that the effective restriction diameter between consecutive subs decreases from the first sub (nearest the surface) to the last sub (deepest in the wellbore) in the pipe string. In other embodiments of the invention, at least fifty seating subs 12 may be provided and arranged so that the effective restriction diameter between consecutive subs decreases from the first sub (nearest the surface) to the last sub (deepest in the wellbore) in the pipe string. In the course of such pipe string make-up, records will be made of the number of standard pipe joints or drill collars between each seating sub 12. Hence, the distance from the top end of the pipe string to each seating aperture is a measured value. Of course, the number of seating subs and restrictions will depend on the length of the overall pipe string and the diameter of the pipe in which restriction are formed.

While the seating aperture 24 may take any shape, in the preferred embodiment, the apertures are formed of a lip or flange symmetrically disposed around the interior 42 of a seating sub 12, thereby forming an immovable opening that is axially fixed and aligned relative to the internal bore of the seating sub. Preferably, this seating aperture is formed with a continuous, fluid sealing face 44. However, those skilled in the art will appreciate that for certain applications that do not require a fluid tight seal, the seating aperture 24 need not extend fully around the interior of the seating sub 12 so long as a resulting aperture is formed to function as a restriction, thereby creating a seat on which an object can land. Nor does the aperture need to be symmetrical or axially aligned relative to the pipe sub, so long as the overall system comprises apertures of varying size arranged in consecutive order as described herein. For example, the seating aperture 24 may take the form of one or more tabs, fingers or projections extending into the bore of a pipe sub so as to form a "restriction" therein.

In one preferred embodiment, the seating aperture 24 has an upper sealing surface 44 and lower surface 46. The upper surface 44 is contoured so as to engage an object provided with a similarly contoured profile, thereby permitting a seal to be formed between the object and the sealing surface when the object is seated on the upper surface 44. In the example of FIG. 2, upper surface 44 is curved to form a concave profile and disposed to receive an object with a correspondingly rounded or tapered shape (such as is shown on drop assembly 22 of FIG. 3). Once an object is seated, a seal is formed between the object and the sealing surface 44 as pressure is applied to the object by the fluid column above the object or otherwise by downwardly pumped fluid to the extent the object is disposed to pass fluid therethrough. In one example, if the object is connected to a explosive device, pressure from the surface applied to the upper end of the explosive device not only maintains the seal as described but may also be utilized to activate the explosive charge below the seal.

Figure 3:
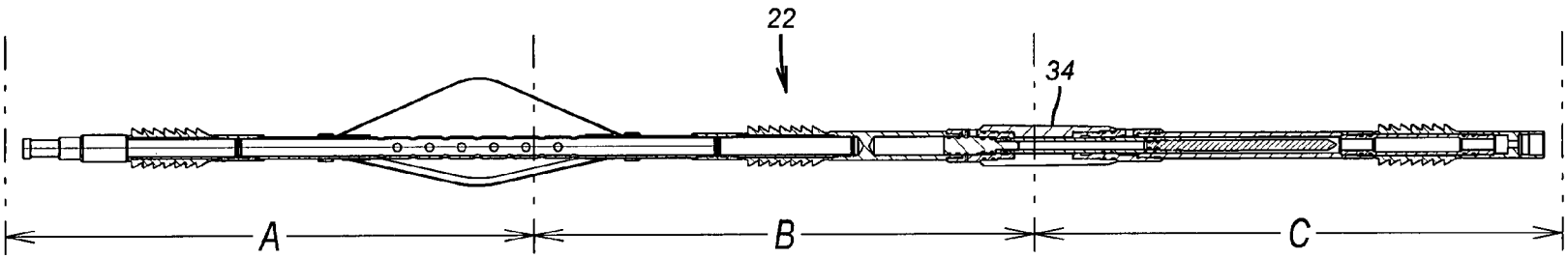
FIG. 3 illustrates the invention drop assembly.
Figure 3A:
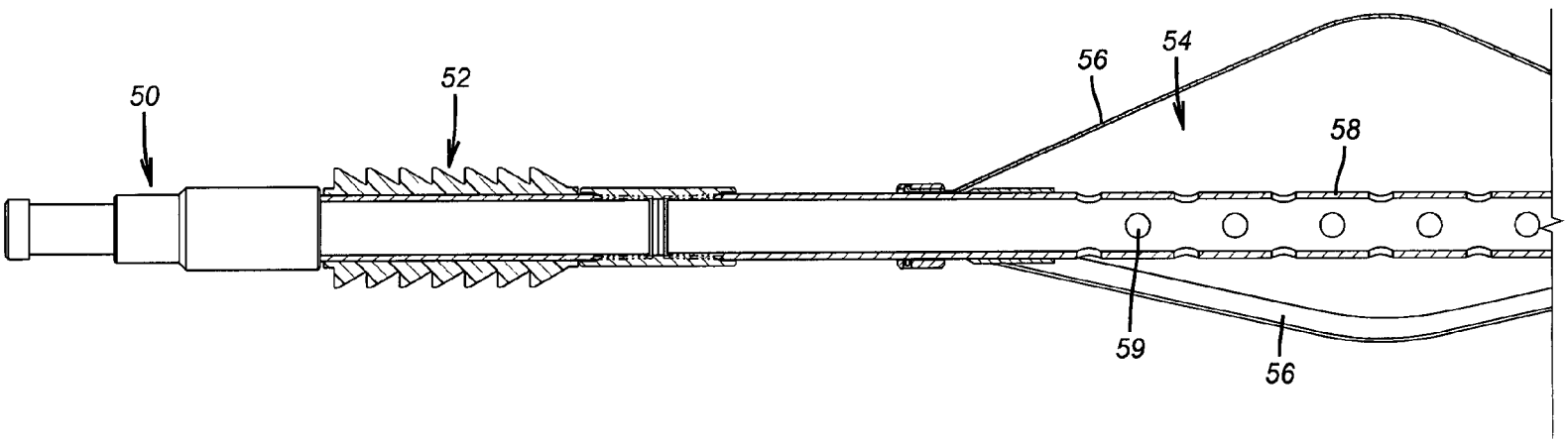
FIG. 3A is an enlarged, partially sectioned view of the drop assembly along the top section A of FIG. 3.

DROP ASSEMBLY: The drop assembly 22 illustrated by FIG. 3 is a preferred configuration for a tool, device or object that may be conveyed in a pipe string and externally shaped for landing on and engaging the seating aperture 24. One intent of the invention is to provide a universal tool body adapted to receive a specifically sized sealing plug element 34 secured to the exterior of the tool body. A variety of standard downhole devices or service tools attached to the tool body, usually below the sealing plug, provide flexibility in the system for use with whatever tool and for whatever purpose is desired. Thus, in one embodiment of the invention, sealing plug 34 may be integrally formed as part of the device with which it is utilized, while in another embodiment of the invention, sealing plug 34 may be secured to the exterior of such device as an independent attachment The basic elements of the drop assembly 22 are shown by the enlarged sections of FIGS. 3A, 3B, and 3C which correspond to segments A, B and C of FIG. 3. With respect to FIG. 3A, a fishing head 50 may be provided at the upper end of the assembly 22 for independent tool descent or removal from the pipe string when desired. The anticipated normal use of the drop assembly 22 is a free release of the assembly at the surface 11 into the pipe string bore for pumped displacement or free-fall until the sealing plug 34 engages the seating aperture 24. To control the rate of assembly descent, one or more units of swab cups 52 are provided to restrict the flow rate of standing bore fluid past the assembly as it descends. If pumped down the pipe bore, the swab cups 52 provide a ring seal between the assembly 22 and the pipe bore wall to increase the operational area of the upper pressurized fluid upon the assembly 22. Additional to the swab cups 52 are one or more resilient centralizers 54 to keep the assembly aligned with the pipe string axis during the descent. Although there are many pipe centralizer configurations. the present embodiment provides three spring blades 56 secured to a carrier tube 58. Apertures 59 in the carrier tube wall allow pressure equalization between the carrier tube interior and the surrounding pipe string bore.

Figure 3B:
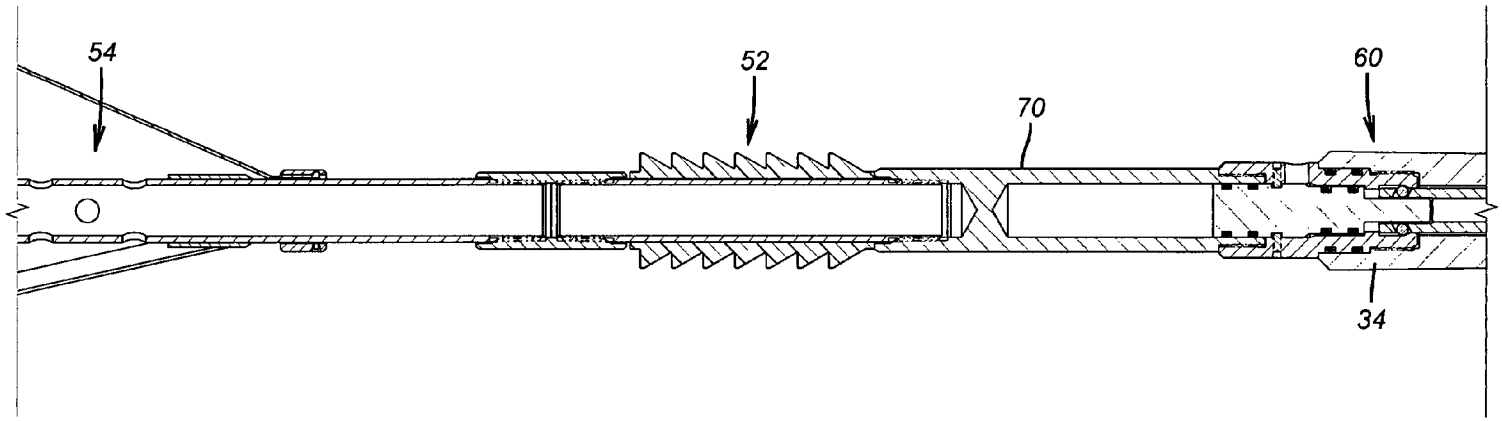
FIG. 3B is an enlarged, partially sectioned view of the drop assembly along the mid-section B of FIG. 3.
Figure 3C:
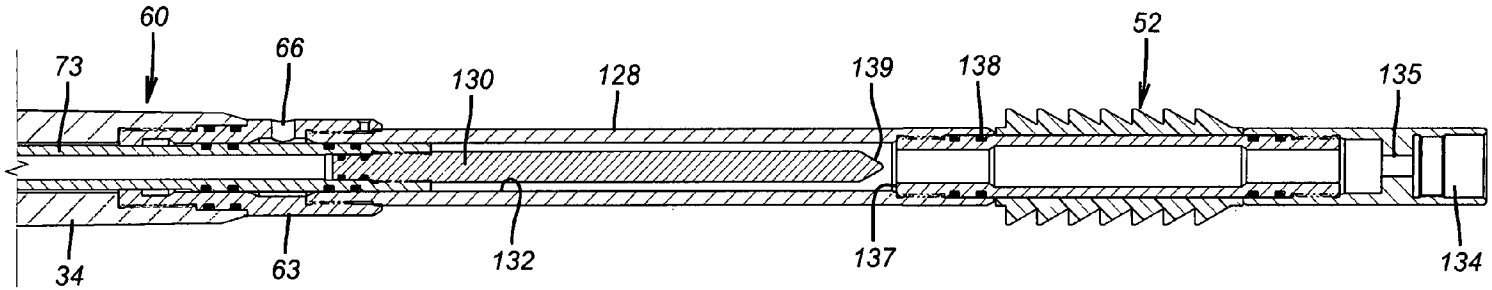
FIG. 3C is an enlarged, partially sectioned view of the drop assembly along the bottom section C of FIG. 3.
Figure 4:
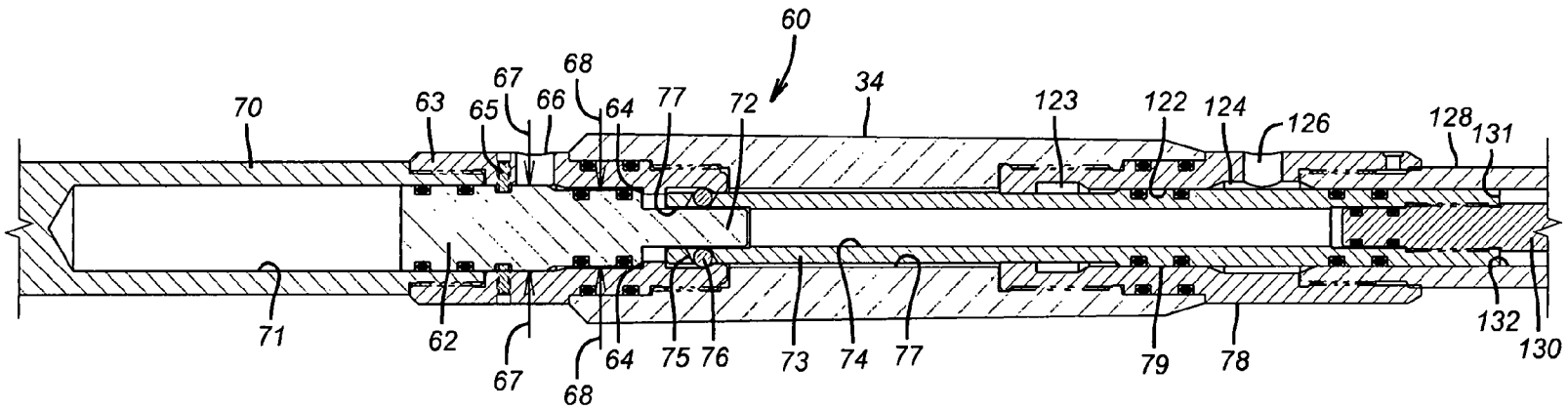
FIG. 4 is an enlarged sectioned view of the present invention firing head.

FIGS. 3B and 3C collectively illustrate the drop assembly firing head 60 which is also shown in enlarged section by FIG. 4. Central to the firing head 60 is a release valve mechanism comprising a differential area piston 62 that is initially held against an annular ledge as a bottom seat 64 in a bore sleeve by shear pins 65. The piston 62 upper diameter 67 is greater than the diameter 68 below the fluid port 66. Displacement of the piston 62 from an initial, port 66 closing position may only occur in an upward direction into a blind bore 70 by pressure differentially shearing pins 65. Accordingly, the piston 62 is positively caged from accidental or shock release as it descends along the pipe string bore.

The sleeve 63 is threaded onto a tube extension 70 below the swab cup 52. Tube extension 70 includes a blind bore 71 of substantially the same inside diameter as the large diameter 67 of the piston 62.

A reduced diameter pintle 72 projects from the lower face of piston 62 into the bore 74 of a fluid transfer tube 73. the upper end of the transfer tube is perforated by a plurality of biased angle apertures 75. Each of the apertures 75 contains a latching ball 76 which has substantially the same diameter as the annulus thickness that is the differential between the pintle 72 radius and radius of the counterbore 77 in the bore sleeve 63.

For the preferred embodiment, the transfer tube 73 extends through an axial bore 77 in the sealing plug 34 into a release sleeve 78. A fluid flow annulus is provided between the outer perimeter of the transfer tube 73 and the inside wall of the sealing plug bore 77.

At the release sleeve end of the transfer tube 73, the transfer tube 73 is given an enlarged outside diameter 79 for a sliding, O-ring seal fit within a release sleeve bore restriction 122 between annular chambers 123 and 124. The lower chamber 124 is ported by apertures 126 into the surrounding pipe string annulus A firing pin housing tube 128 is threaded into the release sleeve 78 (FIG. 4). The upper end of firing pin 130 is seated within the lower end of the transfer tube bore 74 with an O-ring fluid seal. The lower distal end 131 of the transfer tube engages a perimeter shoulder on the pin 130 to limit penetration of the pin 130 into the transfer tube bore 74. The outside perimeter of the transfer tube 74 lower end is given and O-ring fluid seal fit within the housing tube bore. The up end 137 (FIG. 3C) of a linking tube 138 between a tool coupling 134 and the lower end of the housing tube 128 provides a travel limit shoulder for the transfer tube 73 and hence, the firing pin 130. For the purpose of a pyrotechnic tool such as a jet or shaped charge tubing cutter, a percussion activated explosive initiator 135 will be secured in the tool coupling 134. The stroke of the transfer tube 73 along the housing tube bore 132 is designed to bring the firing pin 130 striker point 139 into physical contact with the percussive initiator 135.

In most applications, plug 34 engagement of a predetermined seating aperture 24 will isolate the pipe string bore into an upper fluid pressure zone above the seating aperture 24 and a lower pressure zone below the seating aperture 24. The pressure in the upper zone at the seating aperture 24 is determined by the fluid head standing above the seating aperture 24 and any externally applied pump pressure. Pressure in the pipe string bore below the seating aperture 24 is usually determined by multiple factors such as the standing fluid head in the wellbore annulus, the presence of well packers, and the in situ bottom hole well pressure.

To trigger the firing pin against the explosive initiator 135, fluid pressure in the upstream pipe bore is raised by pump pressure to exceed that of below the seating aperture by a sufficient differential to shear the pins 65. Upper pipe bore fluid pressure enters the drop assembly through ports 66 to bear against the differential area piston 62. Due to the dimensional difference between the large diameter 67 end of the piston and smaller diameter end 68, a net shear force on the piston 62 is borne by the shear pins 65. When the pins 65 fail under this differential area force, the piston 62 is driven upward into the blind bore 71 of extension tube 70. When the piston 62 enters the blind bore 71, the pintle 72 is extracted from the upper bore end of transfer tube 73. Resultantly, the latching balls 76 are released into the bore 74 of transfer tube 73.

When the differential area piston 62 shifts upward into the blind bore 71, pressurized fluid in the upper pipe string bore also enters the inner chamber of the bore sleeve 63 to bear against the transfer tube 73 cross-section. The force of such cross-sectionally applied fluid pressure drives the transfer tube 73 downward along the sealing plug bore 77 and firing pin striker point 139 against the explosive initiator 135. Simultaneously, the enlarged diameter section 79 of the transfer tube 73 is shifted downwardly from sealing contact with the release sleeve bore restriction 122. The latter shift permits fluid flow from the upper pipe string segment to pass through the port 66 into the flow annulus between the transfer tube 73 and sealing plug bore 77 and out the release sleeve aperture 126 thereby bypassing the pipe string bore seal at the plug seating aperture 24.

This fluid by-pass opening between ports 66 and 126 allows the drop assembly and any attached tool to be withdrawn from the pipe string by a wireline connected to the drop assembly fishing neck 50. As the drop assembly 22 is lifted, the by-pass opening allows fluid in the pipe string bore to drain past the drop assembly into the pipe string bore below the drop assembly.

CUTAWAY SUB The foregoing description has been of a system for precisely placing a specialty tool along the length of a pipe string bore. Among the numerous downhole operations receiving advantage from such positioning accuracy is that of pipe cutting. There are occasions when it is advantageous to sever a pipe string downhole and withdraw the upstring portion. The severed lower portion of the pipe string may be either abandoned in place or, as the usual case, recovered by one of numerous "fishing" techniques. When the objective is to sever a drill pipe, care is taken to place the cutting tool at a point along the pipe length between the pipe coupling joints. Pipe coupling joints normally have a considerably greater wall thickness than the nominal wall of the pipe. The thinner wall thickness of the nominal pipe wall is more easily severed with a 'clean' cut face without flash, burrs or flare which may interfere with extraction of either the severed, uphole string or of the downhole string.

Drill collars, however, are a special case wherein the outside diameter of a pipe joint is the same as the coupling diameter along the entire joint length. The functional purpose of such a configuration is for ballast weight at the bottom end of the drill string. Moreover, when a pipe string becomes 'stuck" in a borehole in progress, it is frequently due to bore wall sloughing into the bore annulus around the drill collars. Hence arises the occasional necessity to sever the drill collar string mid-length. It is for this task, that the combination of the seating sub 12 as described above with a cutaway sub 14 is particularly useful. With respect to FIG. 1, for example, the seating sub 12 and cutaway sub 14 are positioned between upper and lower drill collars 10 and 16, respectively. Depending on the length of the drill collar assembly there may be a plurality of seating sub and cutaway sub combinations distributed along the drill collar segment of the pipe string.

Figure 6:
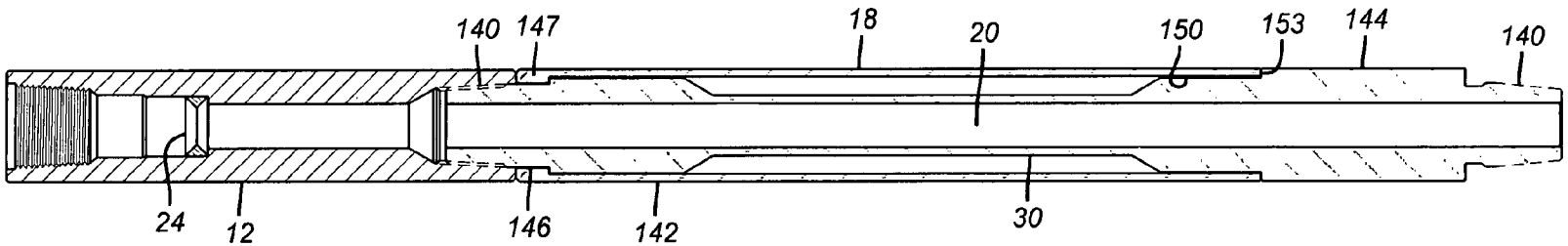
FIG. 6 is a sectioned view of the preferred cutaway sub embodiment.

Turning to the exploded view of FIG. 5 and cross-sectional views of FIGS. 5A-A and 6, one preferred embodiment of a cutaway sub 14 is shown to include a sacrificial mandrel 20 having male threaded end-pins 140 at both ends. Axially adjacent the end-pins are stepped bosses 142 and 144. between the two stepped bosses 142 and 144 is a relatively thin wall tube section 30 having an outside diameter that is substantially less than the nominal drill pipe or collar diameter. The upper (smaller) stepped portion 146 of boss 142 adjacent the threads 140 is formed with chordal wrench flats corresponding to the wrench flats 149 in the torque sleeve collar 147 shown by FIG. 5A-A. The number of wrench flats 149 is shown on the inside perimeter of the sleeve collar 147 are only a representative example. Those of ordinary skill will understand the collar 147 and boss step 146 may be given as many flats as required to transfer the forces necessary for rotatively driving the drill string below the seating sub 12.

The greater outside diameter section of stepped boss 142 is dimensioned to receive the inside diameter of torque sleeve 18 with a slip-fit overlay.

The smaller, outside diameter section 150 of lower boss 144 also is preferably given a value corresponding to a slip fit overlay of the torque sleeve 18. The larger diameter section 152 of the lower boss 144 may be essentially the same diameter as the drill collars 10 or 16. The shoulder 153 between the two sections is cut with an undulating profile such as the lug socket profile 154 for meshing with a corresponding lug socket profile 156 in the end of torque sleeve 18.

It will be understood that the rotary torque transfer function accomplished by the meshed wrench flats 149 in the torque sleeve collar 147 and the mandrel boss 146 may also be served by a multiplicity of meshing splines. In either case, the sleeve 18 is assembled with the mandrel 20 by an axially sliding fit to mesh the sleeve lug profiles 156 with the corresponding profiles 154 in the mandrel boss 144. Simultaneously, the wrench flats 149 mesh with corresponding flats on the mandrel boss 142. When the mandrel threads 140 are meshed with corresponding threads in the seating sub 12, the torque sleeve 18 is firmly secured against the upper mandrel boss shoulder 146 and the dominance of all torsional stress transferred by the seating sub 12 to the sacrificial mandrel 20 is carried by the torque sleeve. 18.

As previously described, numerous sub-sets of seating subs 12 and cutaway subs 14 may be distributed along the pipe string additional to those among the drill collars. When an occasion arises to sever the pipe string at a specific point, the drop assembly 22 is equipped with the sealing plug 34 corresponding to the assigned seating aperture 24 that is most proximate above the point of desired string separation. The pipe cutting tool, also secured to the drop assembly, is positioned below the sealing plug 34 at the same, precisely known distance as is the center of the thinwall section If sacrificial mandrel 20 below the seating aperture 24. Hence, when the drop assembly 22 settles upon the seating aperture 24; it is known with confidence, that cutting tool is correctly positioned relative to the sacrificial mandrel 20.

It is also known, with confidence, that the drop assembly 22 has, in fact, settled against the designated seating aperture 24 by the fluid pressure rise within the pipe string bore against a surface pump supply. As the drop assembly descends the pipe string. The pipe bore pressure remains at circulation pressure. When the sealing plug 34 settles against the seating aperture 24, circulation is terminated and bore pressure abruptly rises against the firing head 60. This pressure rise will continue until the shear pin 65 rupture pressure is achieved to shift the differential area piston 62 upwardly off the bottom seat 64 and release the latching balls 76. When the latching balls fall into the transfer tube bore 74, the transfer tube 73 shifts downwardly to open the upstream fluid port 66 to flow communication with downstream fluid flow port 126. When flow communication is established between fluid ports 66 and 126, the bore pressure abruptly drops to the circulation pressure. Consequently, when the pipe string pressure abruptly spikes and then falls, it may be known that the drop assembly 22 has settled on the seating aperture 24, the firing head has opened, the firing pin as fallen and the pipe cutter 28 or perforating gun has discharged.

In the usual course of operations, after discharge of the cutter 28, the upper pipe string is withdrawn from the wellbore along with the seating sub 12, the torque sleeve 18 and the upper portion of the sacrificial mandrel 20 including the upper boss 142. Of the original cutaway sub 14, only the lower boss 144 and lower pipe string remain in the wellbore subject to abandonment or further retrieval operations.

Figure 7:
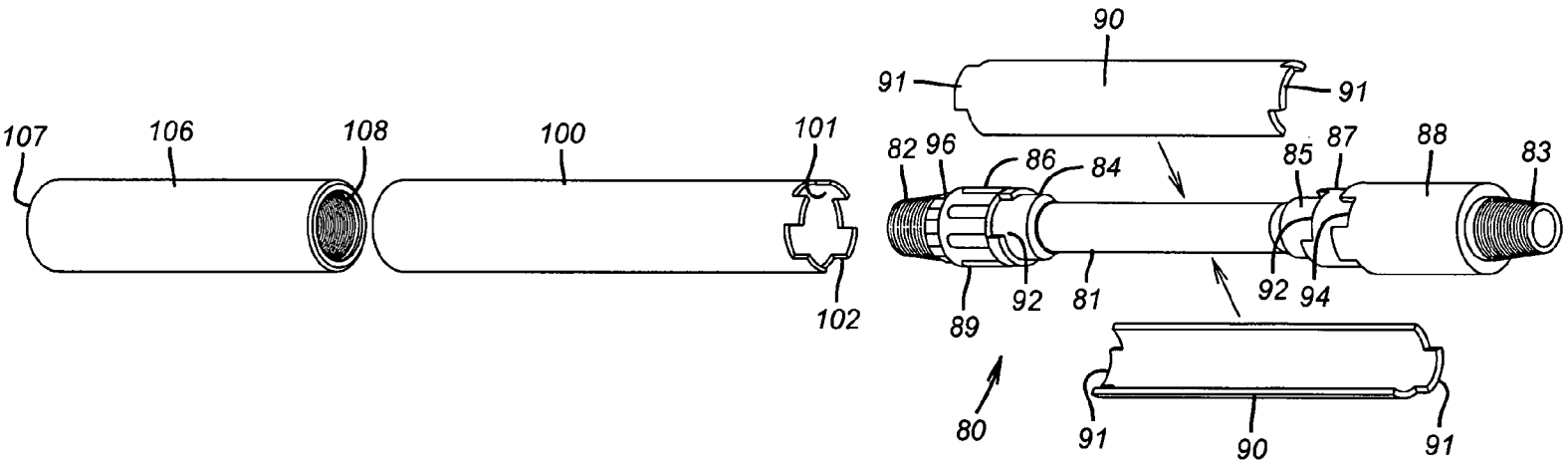
FIG. 7 is an exploded view of an alternative cutaway sub embodiment.
Figure 8:
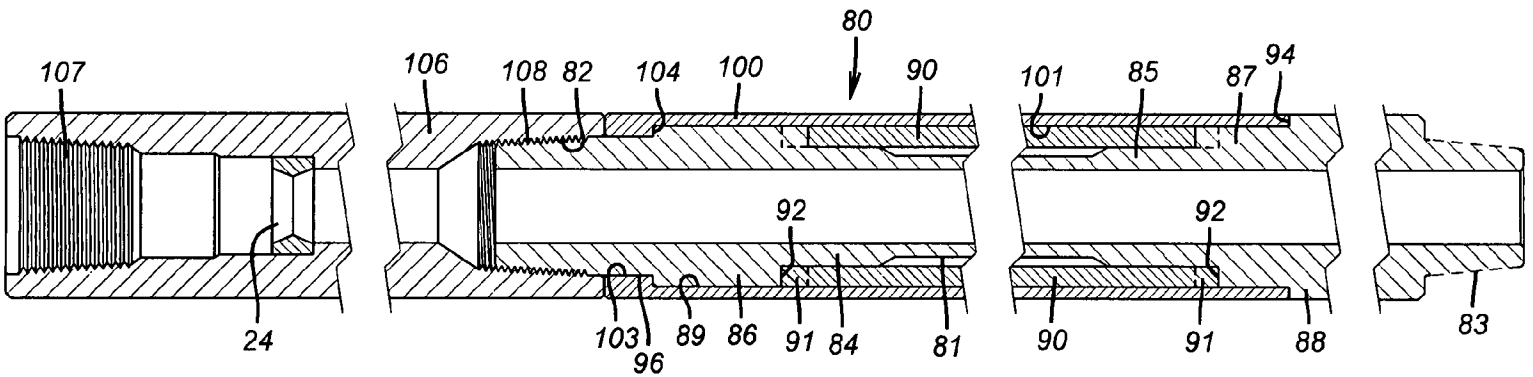
FIG. 8 is a sectioned view of the FIG. 7 cutaway sub embodiment.

An alternative embodiment 80 of the cutaway sub with increased buckling strength is represented by FIGS. 7 and 8 as having a reduced wall thickness tube 81 between stepped bosses 84 and 85. The upper end of the reduced wall tube 81 is terminated by an interior portion of the upper stepped boss 84. The lower end of the tube 81 is terminated by the interior portion of the lower stepped boss 85. Both interior boss portions are of greater outside diameter than the reduced wall tube 81. At an axial set-back in opposite directions are an intermediate pair of stepped bosses 86 and 87 having a greater OD than the interior bosses 84 and 85. The abutment transition between the interior and intermediate bosses is profiled with lug detents 92. Meshing with the lug detents 92 are the lug projections 91 at opposite distal ends of a split sleeve 90. There may be a plurality of such meshing lug projection 91 and detents 92.

The internal bore 101 of torque sleeve 100 is sized to pass freely but closely with a slip fit over the intermediate bosses 86 and 87. Lug 102 on the lower end of sleeve 100 are sized and configured to mesh with the lug detents 94 in the lower pin collar 88. Referring to FIG. 8, an inside abutment face 104 of end collar 103 is positioned at the distal end of sleeve bore 101 to engage a mating abutment face on the intermediate stepped boss 86 as the sleeve lugs 102 mesh with the collar detents 94. Internal wrench flats on the upper stepped boss 96 as described for FIG. 5A-A are sized and configured to mesh with mating wrench flats (not shown) on the interior perimeter of the sleeve 100 end collar 103.

A seating sub 106 may be constructed with tapered box threads 107 and 108 at opposite ends. When the tapered threads 82 and 108 are in full engagement, the inside abutment faces of the sleeve collar 104 and intermediate boss 86 are in compressed juxtaposition.

Those of skill in the art will appreciate the operative consequence of the FIGS. 7 and 8 assembly as not only stiffening the cutaway sub 80 but is also capable of transferring drive torque across the cutaway sub 80 through both inner and outer sleeves as well as the thinwall tube 81. However, when the thinwall tube 81 is severed, the upper pipe string maintains firm assembly with the sleeve 100 and upper stepped boss elements of the sub 80 for withdrawal from the borehole. When the sleeve 100 is withdrawn. The split sleeve 90 halves have no radial confinement and merely fall away form the severed lower portion of the sub.

Figure 9:
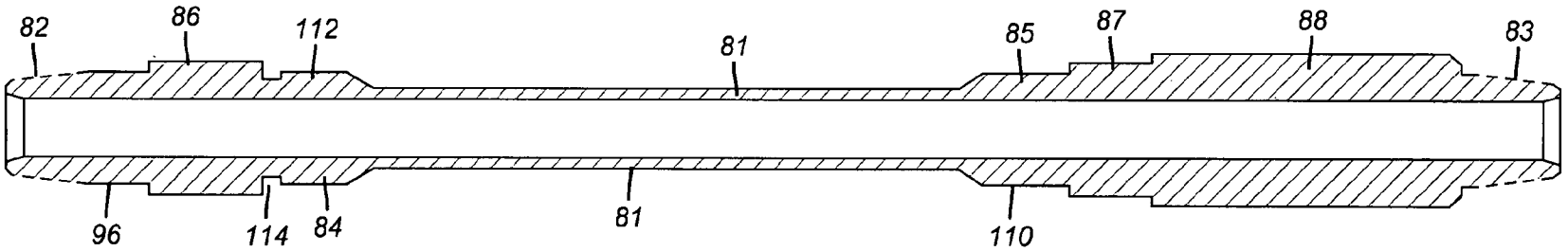
FIG. 9 is a sectioned view of an alternative sacrificial mandrel embodiment.
Figure 10:
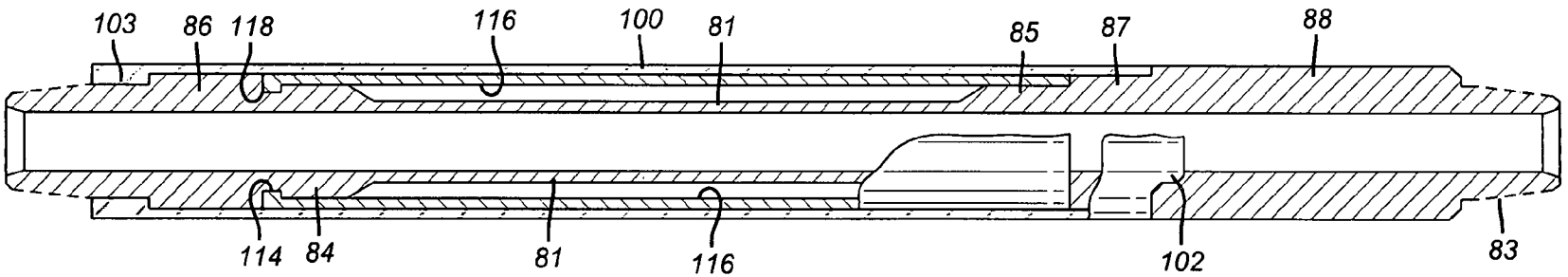
FIG. 10 is a sectioned view of a second alternative cutaway sub embodiment.

In some cases, even the release of the split sleeve halves 90 as borehole debris is intolerable or extremely expensive for a follow-up fishing trip to remove the resulting debris. Responsive to those applications. A third embodiment of the invention as represented by FIGS. 9 and 10 is suggested wherein the inner step 84 of the upper boss is grooved with a perimeter encircling channel 114. The substantially cylindrical surfaces of both inner steps 84 and 85 may be cut with wrench flats 110 and 112.

A further modification of the FIGS. 9 and 10 embodiment may include lug and detent engagements of the split sleeve 119 at the lower end as suggested for the FIGS. 7 and 8 embodiment. In either case, whether by lug and detent or by wrench flats, drive torque is transferred from the top seating sub 106 to the lower pin 83 through the additional structure of inner split sleeve 81 and torque sleeve 100.

Those skilled in the art will appreciate that the system described herein provides certainty as to the depth of a tool in a pipe string. Once a drop assembly has landed on a seating aperture 24 and the pipe string pressure is raised against the shear pins 65 to be abruptly released, the drop assembly is known to be on the designated seating aperture and the exact position of a tool attached to the drop assembly relative to the seating aperture is also known.

Figure 11:
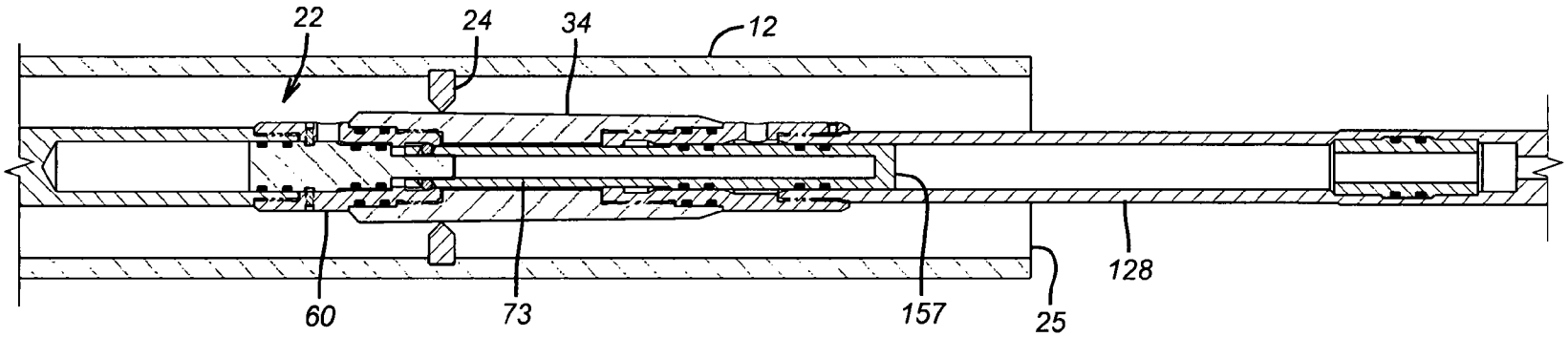
FIG. 11 is a sectioned view of an alternative invention application.
Figure 12:
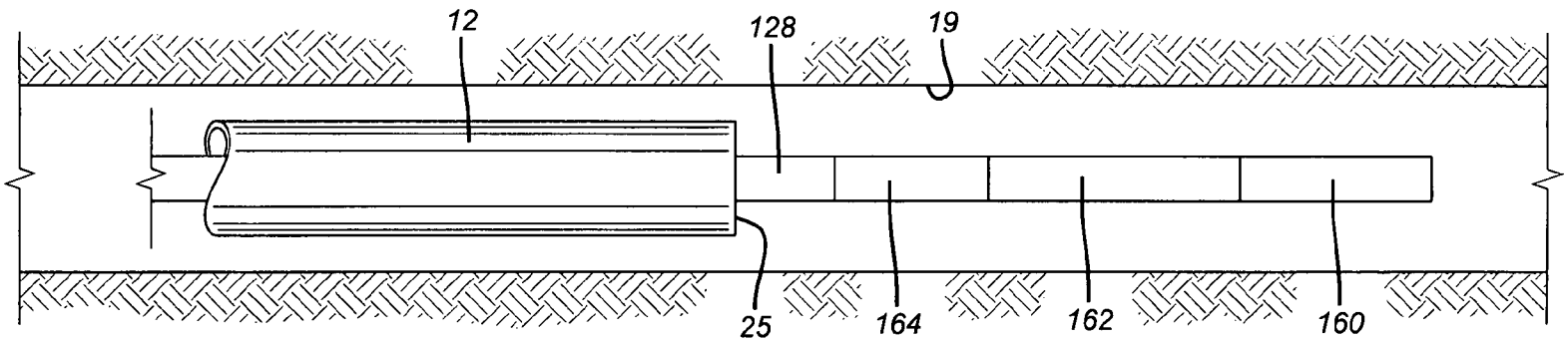
FIG. 12 is a partially sectioned view of a well logging application of the invention.

FIGS. 11 and 12 illustrate an alternative embodiment of a drop assembly configured for placement of a non-explosive tool such as a battery powered well logging sensor for detecting certain geologic characteristics of the earth where penetrated by the wellbore. Distinctively, the transfer tube 73 element of the drop assembly needs no firing pin. Consequently, the distal end of the transfer tube 73 is closed with an end plug 157. The firing head 60 becomes a one-time pressure actuated release valve. The housing tube 128 becomes an extension to which a battery pack 164, a data recorder 162 and well logging sensor 160 are attached. The seating aperture 24 is positioned within the seating sub 12 to allow at least the sensor 160 end to extend beyond the open end 25 of the seating sub.

When a free falling drop assembly, for example, carries sensitive instrumentation such as well logging sensors, it may be prudent to finish the internal bore of the seating sub 12 for an extended distance above the seating aperture 24 to more closely interact with the swab cups 52 to slow the drop assembly descent before engaging the seating aperture 24.

The total length of the pipe string, including the distal end 25 of the seating sub 12 and the position of the sensor 160 relative to the seating aperture 24 will be known. When pump pressure shears the pins 65 and a pump pressure spike is suddenly released, it is known, with confidence, exactly where the sensor 160 is located within the wellbore 19. If the data recorder 162 operates continuously, the well may be logged continuously from the known position as the supporting pipe string is withdrawn with the logging tool attached. It will be recalled that the firing head by-pass valve is open therefore permitting standing pipe bore fluid above the seating aperture 24 to by-pass the seal and equalize the fluid pressure as the pipe string rises.

An additional benefit of the system is that a symmetrically disposed seating aperture within a pipe bore allows tools positioned with the system to be centralized in a pipe string resulting in substantially improved performance of the explosives relating to the pipe recovery system.

While the system of the invention is best utilized in the context of a vertical wellbore, those skilled in the art will understand that the invention may also be utilized in other elongated tubing sections where a fluid is pumped through the tube and an operation at a precise distance into the tube is required, including without limitation, horizontal wellbores, sewer lines, pipe lines and the like.

Likewise, while the system preferably eliminates the need for e-line, wireline, slickline or similar vehicles as a method for placement of a device, the system may still be utilized in conjunction with such vehicles to control the travel of such devices through the pipe string.

Although the invention disclosed herein has been describe in terms of specified and presently preferred embodiments which are set forth in detail, it should be understood that this is by illustration only and that the invention is not necessarily limited thereto. Alternative embodiments and operating techniques will become apparent to those of ordinary skill in the art in view of the present disclosure. Accordingly, modification of the invention are contemplated which may be made without departing from the spirit of the claimed invention.

The invention claimed is:

1. A system for positioning a downhole service tool in the interior of a pipe string, said system comprising:

a. a plurality of tubular sub-sections distributed between selected pipe joints in a pipe string length comprising a plurality of pipe joints joined coaxially from a first to second end thereof, each sub-section having a bore substantially coaxial with a bore of said pipe string and a substantially circular aperture in a cross-section of said bore with an inside diameter distinctive to each sub-section, means for securing at a respective immovable position along the axis of said pipe string each aperture of said plurality of sub-sections, said distinctive aperture diameters diminishing incrementally by successive positions from said first to second ends: and,:

b. an axially elongated tool assembly including a downhole service tool disposed for independent transport along a said pipe string bore, said tool assembly having a cross-sectional profile adapted to engage a specific one of said apertures with a fluid pressure seal to isolate a first end pipe string bore from a second end pipe bore, said tool assembly including a fluid pressure actuated valve to selectively by-pass said specific aperture with fluid flow in a direction from said first end toward said second end.

2. A system for positioning a downhole service tool as described by claim 1 wherein said pressure actuated valve comprises a fluid pressure displaced piston to open a fluid flow route from said pipe bore past said specific aperture.

3. A system for positioning a downhole service tool as described by claim 2 wherein said piston is displaced in a first direction opposite to said fluid flow direction.

4. A system for positioning a downhole service tool as described by claim 2 wherein said piston is structurally prevented from displacement in said flow direction.

5. A system for positioning a downhole service tool as described by claim 2 further comprising firing pin means releasably latched to said pressure displaced piston, wherein displacement of said piston shears a shear pin for piston displacement in a direction opposite to said flow direction.

6. A system for positioning a downhole service tool as described by claim 1 wherein said service tool is a pipe severing tool.

7. A system for positioning a downhole service tool as described by claim 1 wherein said service tool is a perforating gun.

8. A system for positioning a downhole service tool as described by claim 1 wherein said service tool is a well logging sensor.

9. A system for positioning a downhole service tool as described by claim 1 wherein said distinctive aperture subsection is proximate of the distal end of said pipe string and said service tool is a well logging sensor projected by said tool assembly beyond said distal end.

10. A system for positioning a downhole service tool as described by claim 1 wherein said tool assembly is adapted for transport along said pipe string bore by pump pressure.

11. A system for positioning a downhole service tool as described by claim 1 wherein said tool assembly is adapted for freefall transport along said pipe string bore.

12. A system for positioning a downhole service tool as described by claim 1 wherein said tool assembly includes swab cups to regulate the transport rate along said pipe string bore.

13. A system for positioning a downhole service tool as described by claim 12 wherein one or more of said subsection bores are surface finished to cooperate with said swab cups.

14. A method of accurately placing a downhole service tool at a specified location along the length of a pipe string in a wellbore, said method comprising the steps of:

providing a plurality of pipe subsections in a pipe string make-up, said subsections distributed at measured locations along a length of said pipe string;

providing bore restrictions in said pipe subsections substantially normal to an axis of said pipe string, an effective aperture diameter of said bore restrictions being less than an inside bore diameter of said pipe string;

sequencing the positions of said subsections in said pipe string, from a top end to a bottom end, by progressively reduced effective diameters of said apertures;

providing a tool assembly including a downhole service tool secured thereto for axial bore transport along said pipe string;

providing an aperture closure surface around said tool assembly distinctive to a specific one of said restriction apertures whereby said closure surface is adapted to substantially close said respective aperture with a fluid seal, said closure surface having a known axial separation distance from said service tool;

providing said tool assembly with a fluid flow path past said sealed aperture in a flow direction from above said restriction to below said restriction;

providing a fluid flow obstruction in said flow path that is displaced by fluid pressure in said pipe string bore above said aperture, said obstruction being displaced in a direction opposite to said flow direction to open said flow path;

depositing said tool assembly in said pipe bore for traversal thereof until engaging said distinctive restriction and sealing said aperture;

increasing fluid pressure within said pipe string above said distinctive restriction to displace said fluid flow obstruction; and, detecting a release of fluid pressure within said pipe string upon opening of said flow path to verify the location of said service tool.

15. A method as described by claim 14 wherein said service tool is a pyrotechnic device.

16. A method as described by claim 15 wherein displacement of said fluid flow obstruction releases a pyrotechnic device firing pin.

17. A method as described by claim 15 wherein said pyrotechnic device is a pipe severing tool.

18. A method as described by claim 15 wherein said pyrotechnic device is a jet cutter.

19. A method as described by claim 15 wherein said pyrotechnic device is a perforating gun.

20. A method as described by claim 15 wherein said pyrotechnic device is a shaped charge.

21. A method as described by claim 14 wherein said service tool includes a well logging sensor.

22. A method as described by claim 14 that provides a sacrificial mandrel means in said pipe string proximate of at least one of said subsections, said sacrificial mandrel means having a thinner annulus wall than adjacent pipe string joints.

23. A method as described by claim 22 wherein said sacrificial mandrel is reinforced for torsional strength transfer.

24. A method as described by claim 22 wherein said sacrificial mandrel is reinforced for buckling strength.

25. A method as described by claim 14 wherein one of said pipe subsections is positioned at the distal bottom end of said pipe string whereby said downhole service tool projects along said wellbore outside of said pipe string.

26. A method as described by claim 25 wherein said service tool comprises a well logging sensor.

27. A method as described by claim 26 wherein geologic characteristics of said wellbore are detected by said logging sensor as said pipe string is withdrawn from said wellbore.

* * * * *